United States Patent [19]

Mune et al.

[11] 4,347,488

[45] Aug. 31, 1982

[54] MULTI-POLE CIRCUIT BREAKER

[75] Inventors: Charles Mune, West Hartford; Bohdan Krasij, Avon, both of Conn.

[73] Assignee: Carlingswitch, Inc., West Hartford, Conn.

[21] Appl. No.: 209,159

[22] Filed: Nov. 21, 1980

[51] Int. Cl.[3] ..... H01H 73/06; H01H 71/02

[52] U.S. Cl. ..... 335/9; 335/8

[58] Field of Search ..... 337/9, 8, 10

[56] References Cited

U.S. PATENT DOCUMENTS 3,353,127 11/1967 Francis et al. ..... 335/9

3,530,412 9/1970 Gryctko ..... 335/8

4,090,157 5/1978 Rys ..... 335/8

4,166,988 9/1979 Ciarcia et al. ..... 335/9

*Primary Examiner*—Harold Broome

*Attorney, Agent, or Firm*—McCormick, Paulding & Huber

[57] ABSTRACT

An arrangement is provided for interconnecting a set of two or more circuit breakers such that tripping of one will cause concurrent tripping of the others. A coupler adapted to be placed in a recess defined by the abutting side walls of two adjacent breakers is engageable with trip members in both of the associated breakers and provides operative interconnection between the two breakers. Only one of the breakers of the set need be provided with an operating handle which can be used to turn all of the breakers "on" and "off" in unison.

11 Claims, 8 Drawing Figures

FIG. 1 / HANDLE ON CONTACTS CLOSED
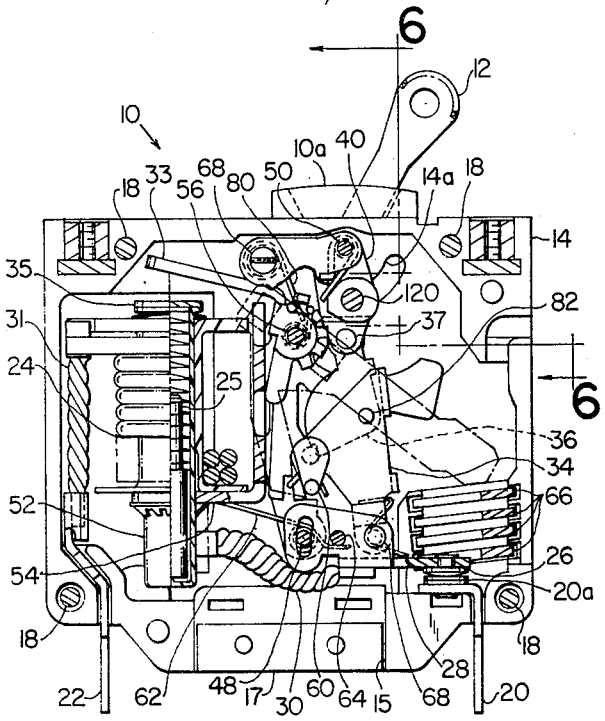
FIG. 3 / HANDLE OFF CONTACTS OPEN
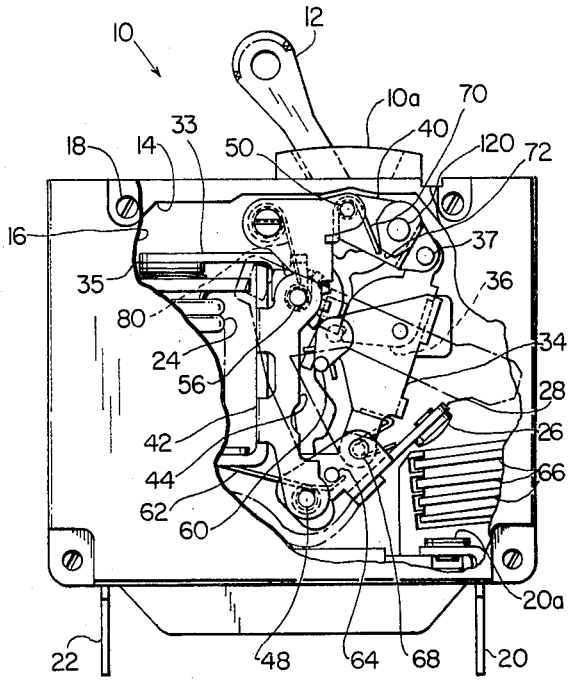
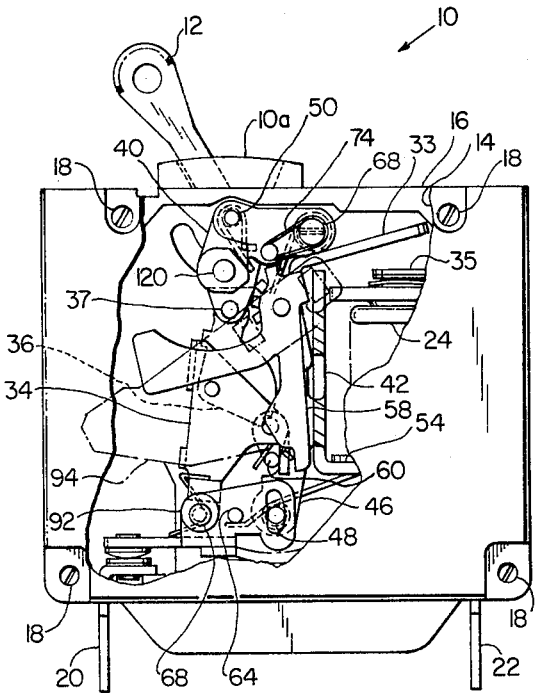
FIG. 2 / HANDLE ON CONTACTS CLOSED
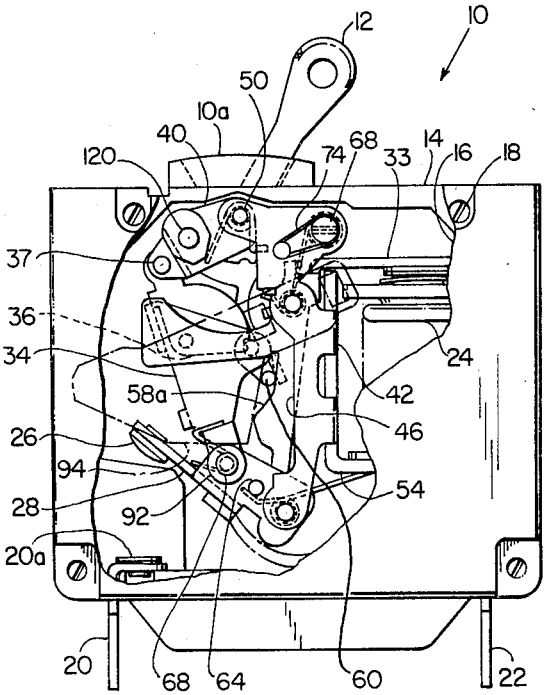
FIG. 4 / HANDLE OFF CONTACTS OPEN FIG. 5 / HANDLE ON CONTACTS CLOSED
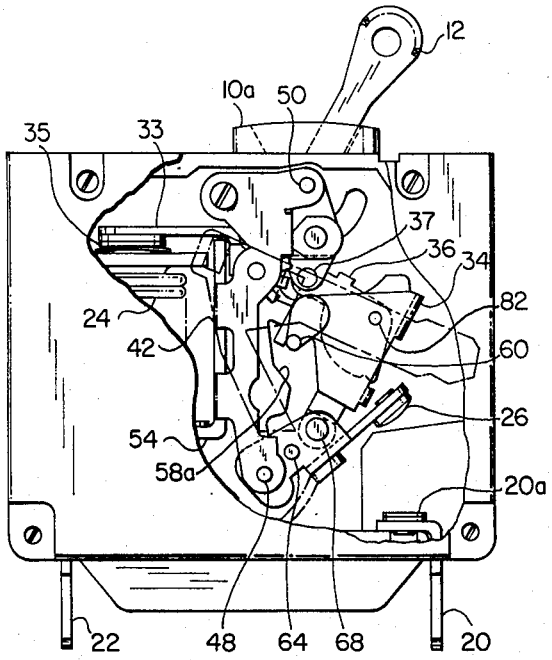
FIG. 6
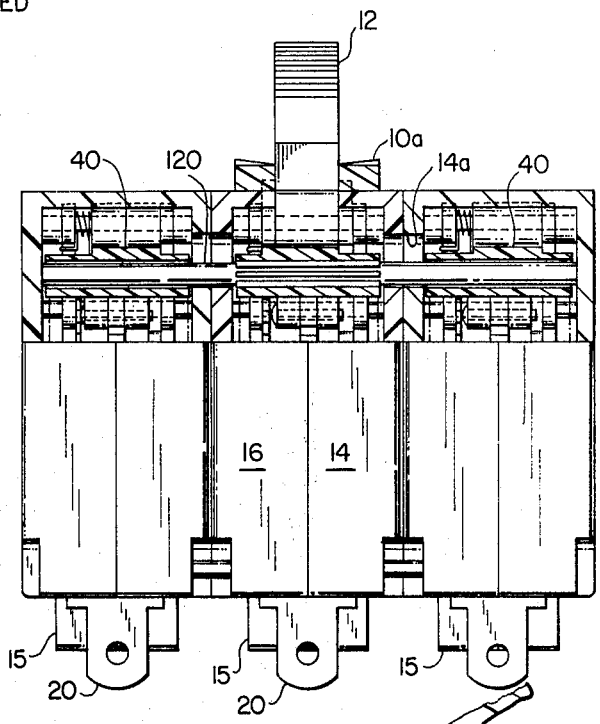
FIG. 7
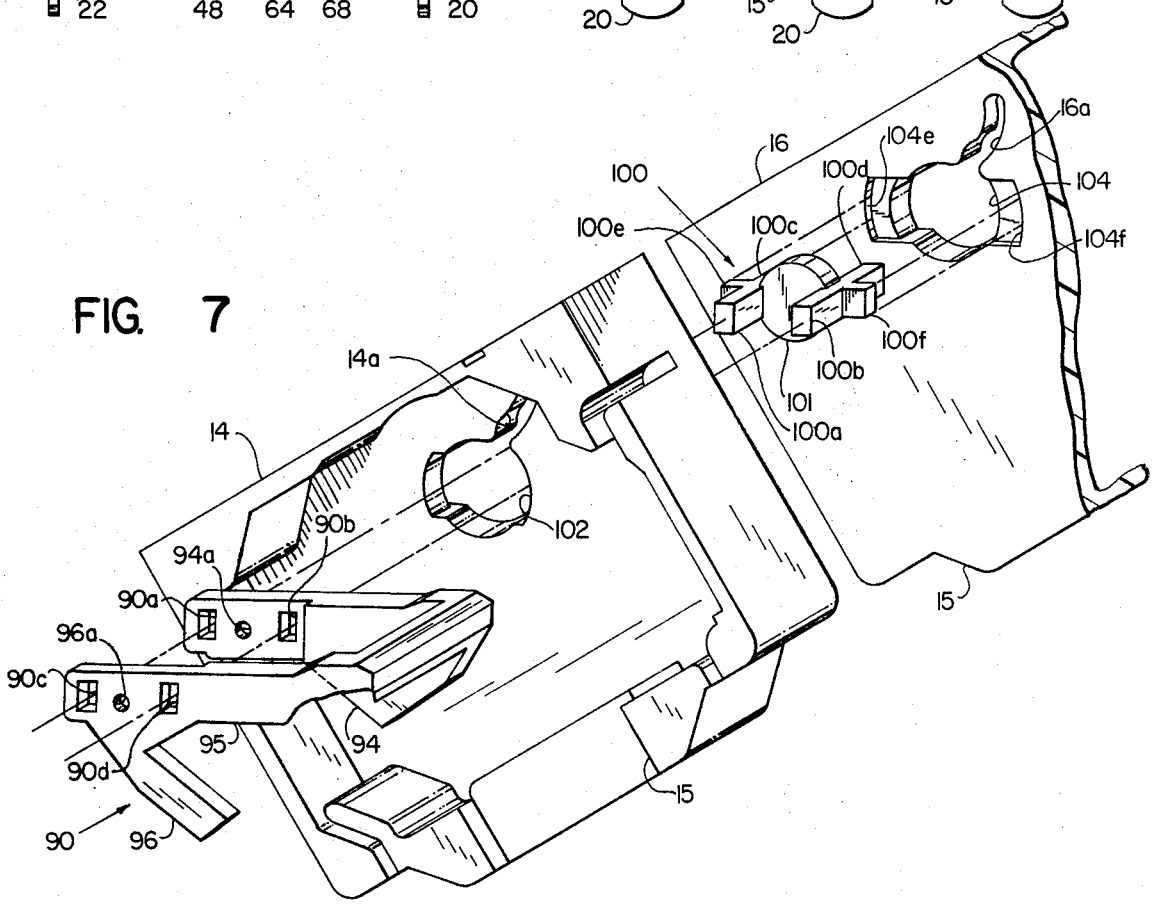

MULTI-POLE CIRCUIT BREAKER

This invention relates generally to multi-pole circuit breakers of the type in which all of the poles, or switch units, comprise circuit breakers of generally similar construction. An object of the present invention is to provide an improved arrangement for interconnecting two or more circuit breakers such that tripping of one will cause the adjacent breakers to trip as a result of a uniquely designed common trip link or member provided in each circuit breaker case. A uniquely located coupling device is provided between these members which obviates the need for utilizing metal members of complicated shape and which simplifies the assembly thereof. Another object of the present invention is to provide a multipole circuit breaker having a single operating lever or handle external of the stacked circuit breaker cases, which individual circuit breaker cases are nevertheless of generally similar construction with many common parts provided therein.

Among the advantages of the multi-pole circuit breaker disclosed herein are savings to the user or installer in that the assembled multi-pole unit need not be disassembled prior to mounting the unit in a panel or the like as is often the case with gang barred units of identical construction. Also, the user need not drill as many holes in the panel because only one handle is provided in the multi-pole circuit breaker disclosed herein.

In the preferred embodiment the invention is incorporated in a three pole circuit breaker assembly with three similar circuit breaker cases housing three similar circuit breaker mechanisms. Each mechanism is provided with an automatically resettable common trip member pivotally mounted inside each case. The trip member having a generally U-shape such that the legs of the U are located adjacent the inside walls of the case. One of these legs has a portion engageable with the conventional resettable mechanism of the circuit breaker and the other leg of the U has a portion engageable with the conventional circuit breaker tripping device. A common trip coupler is located in a cavity defined in the abutting side walls of the switch cases, and has opposing portions wich cooperate with portions of the U-shaped common trip members inside the adjacent switch cases in order to cause pivotal movement of one of these members to achieve movement of the coupler and hence of the adjacent trip member in the adjacent case. The single handle construction for the three pole circuit breaker shown is provided as a conventional handle in a conventional circuit breaker as generally set forth in U.S. Pat. No. 2,360,922, among others, but the present invention obviates the need for handles in the circuit breakers provided at both sides of said conventional breaker. The absence of excess protruding handle portions for the outside units provides a much improved multi-pole circuit breaker. An inner portion of the handle part in these otherwise conventional breakers is retained, but each such inner "handle" portion or crank arm has a boss portion between its pivoted end and its movable end such that an elongated connector can be provided to joint each of the three crank arms for movement in unison with one another. This configuration provides a single handle external to the three pole circuit breaker case, wich handle can manually operate the circuit breaker in conventional fashion so that all three poles move together. Another advantage of the present invention is that the aforedescribed handle configuration does not detract from the common trip feature referred to previously.

In the drawings, FIG. 1 is a side elevational view of a multi-pole circuit breaker incorporating the present invention, and more particularly illustrates the center breaker in a three pole arrangement with the half-case of this center breaker being removed to show the internal parts of the circuit breaker, the contacts being shown in a closed condition and the handle being shown in the "on" position.

FIG. 2 is a view similar to FIG. 1 but taken from the opposite side of the same breaker, that is the center breaker in the three part unit described herein, and with only a portion of the half case being shown broken away to reveal the internal parts of the mechanism.

FIG. 3 is a view similar to FIG. 1 but with only a portion of the half case broken away to reveal the internal parts of the breaker mechanism, the contacts being shown in FIG. 3 in an open condition, and with the handle in its "off" position.

FIG. 4 is a view similar to FIG. 3 but taken from the reverse side to reveal the various internal parts in the same condition as depicted in FIG. 3 but from the opposite side for purposes of comparison with FIG. 2.

FIG. 5 is a view similar to FIG. 3 except that the handle has been moved to its "on" position without effecting the open condition of the contacts.

FIG. 6 is an end view of the three pole circuit breaker with an upper portion being depicted in section generally on the line 6—6 of FIG. 1.

FIG. 7 is a perspective view of one comon trip member and an adjacent case half or segment together with the common trip coupler which serves to interconnect the common trip members and the adjacent switch case half of the adjacent circuit breaker.

Figure 8:
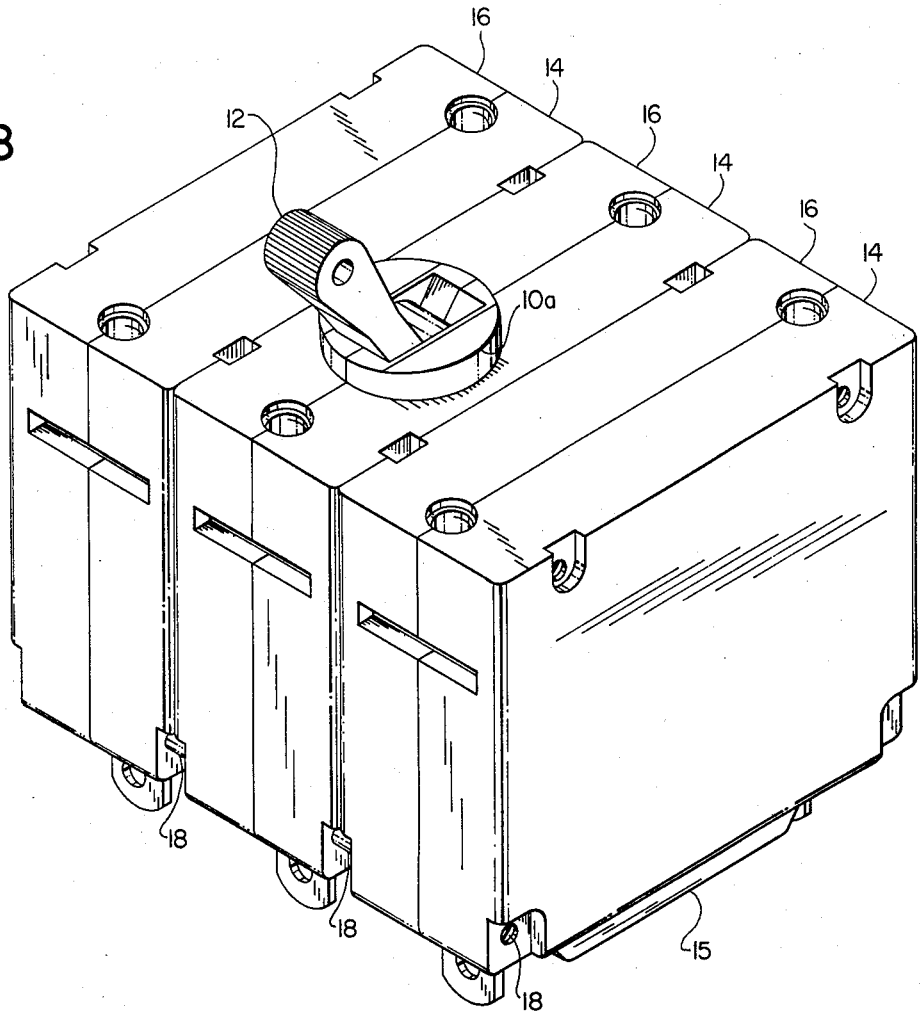
FIG. 8 is a perspective view of a three pole circuit breaker assembly illustrating the single handle to greater advantage, and also illustrating the various mounting holes provided in such an assembly.

Turning now to the drawings in greater detail, FIG. 1 shows the centermost breaker in a three pole circuit breaker assembly comprising individual circuit breaker modules which are identical to one another except for the fact that only one has a boss 10*a*. These modules or cases adjacent the unit shown have no boss 10*a* or protruding handle 12 as best shown in FIGS. 3 and 8.

As shown in FIGS. 1–5 inclusively the circuit breaker unit or module 10 comprises a split case having two halves 14 and 16 conventionally assembled to one another by longitudinally extending fasteners 18 which extend through aligned openings in each of the three adjacent cases (and more particularly the three pairs of split cases as suggested in FIG. 8). These case halves 14 and 16 are preferably molded from an insulating material such as bakelite, or the like and each preferably includes a depending recess defining portion 15 suitable for receiving auxiliary circuit components (not shown). This recess is shown fitted with one type of plug 17 but other plug configuration can be used. The circuit breaker has terminals 20 and 22, the terminal 20 comprising a fixed contact 20*a* for the breaker and terminal 22 comprising the connection for an electromagnetic coil 24.

Turning next to a description of the mechanism provided inside the circuit breaker case, a movable contact 26 is provided on a movable contact arm 28 and is engageable with the stationary contact 20*a* . A flexible lead 30 is provided between the movable contact arm 28 and the lower end of the coil 24 whereas a lead of similar material 31 is provided between the terminal 22 and the upper end of coil 24. The mechanism to be described is generally similar to that disclosed in U.S. Pat. No. 2,360,922 and serves to trip these contacts 20*a* and 26 to the open condition upon predetermined current overloads by reason of the electromagnetic force generated in the coil 24 serving to move armature 33 from the position shown in FIG. 1 to that shown in FIG. 3. A movable core 25 is spring biased downwardly inside the coil 24 as shown in FIG. 1, said plug 25 being magnetically moved upwardly against the force of the spring to magnetically attract the armature 33 in response to such an over current condition.

The contact arm 28 is biased toward the position shown in FIGS. 3 and 4 (that is toward the switch open condition) and is adapted to be mechanically closed by means of the handle 12 as a result of moving the handle from the position shown in FIGS. 3 and 4 to that shown in FIGS. 1 and 2. This closing motion for the contacts is achieved through a three bar linkage consisting of the movable contact arm 28, a collapsible link (consisting of a toggle comprising elements 34 and 36) and a crank arm portion 40 of the handle 12. Handle 12 and its crank arm portion 40 is biased by reset spring 70 wound on pivot pin 50 and having a fixed leg engaging the frame plate 44 and a movable leg engaging abutment 72 on crank arm 40.

The electromagnetic coil 24 is supported in a fixed frame 42, said frame having parallel integrally formed plates 44 and 46 best shown in FIGS. 2 and 4. A pivot pin 48 extends between the lower end portions of these plates 44 and 46 to pivotally support the movable contact arm 28. An upper pivot pin 50 extends through upper portions of these plates 44 and 46 to pivotally support the integrally formed depending crank 40 of handle 12. The entire frame forms a part of the electromagnetic device, which device further includes a metal tube 52, housing the spring biased movable magnetic core 25 described above, such that the movable core is retarded by the action of a suitable fluid in order to provide a time delayed tripping of the mechanism at predetermined overload current conditions. A spring 80, to be described, is adjustable to preset the breaker to trip at a predetermined level of electromagnetic force in coil 24 (and consequently at a predetermined overcurrent condition).

The frame also has a horizontal leg 54 supporting the coil 24, which coil is wound on an insulating spool or bobbin in a conventional fashion. The frame is of magnetically conductive material and a pole piece 35 of the same material may be provided in the non-magnetic bobbin to improve the magnetic conductivity between these fixed elements and the armature.

Turning more particularly to a description of the toggle mechanism defined by the collapsibly connected links 34 and 36, the reader is referred to the disclosure in the above mentioned U.S. Pat. No. 2,360,922 for a more complete description of this aspect of the subject disclosure. However, the following description of the operation of the circuit breaker mechanism is offerred for purpose of clarity. As mentioned above, movement of the handle from the "on" to the "off" positions (shown in FIGS. 1 and 3 respectively) will cause the collapsible toggle defined by the links 34 and 36 to move as a unit such that the circuit breaker acts as a switch in being closed. For achieving opening movement, the handle is moved from the FIG. 3 to the FIG. 1 position and again the toggle links 34 and 36 move as one, being held in place by latch means to be described. Upon the occurence of a predetermined overload condition, assuming the circuit breaker to have its contacts prepositioned to the closed condition of FIGS. 1 and 2, the magnetizable armature 33 is attracted toward the pole piece 35 either after a time delay period or virtually simultaneously, depending upon the design overload current condition. The armature 33 is pivotally mounted and can move toward the pole piece 35 on a pin 56, which pin is secured to the frame plates 44 and 46 described above. Thus, the armature is located between these two plates, and attraction between the pole piece 35 and the armature 33 will cause the depending leg 58 of armature 33 to pivot clockwise as viewed in FIGS. 2 and 4 (counterclockwise as viewed in FIGS. 1 and 3). This depending portion 58 of the armature is adapted to engage a projecting pin 60 forming a part of latch means designed to cause the collapsible link defined by the members 34 and 36 to move in unison from the latched position as shown in FIGS. 1 through 4 to the collapsed (unlatched) position shown in FIG. 5. The pin 60 will move generally vertically from the position shown for it in FIG. 2 to that shown for it in FIG. 4 as a result of spring pressure acting on the movable contact arm 28. This spring pressure is provided chiefly from main spring 62 acting between the underside of frame member 54 and a pin 64 provided in the contact member 28. The contact arm 28 has laterally spaced vertical plates integrally formed therein to define openings for its own pivot pin 48 and said pin 64.

Means is provided for adjusting the spring force necessary to trip the circuit breaker as a result of the current overload necessary to actuate the tripping device described above, and preferably said adjustment is provided in the form of a slotted pin 68 having the coil spring 80 wound thereon between the plates 44 and 46 of the frame with one end of the spring being provided in a slot of said pin and the other end engaging the armature 33. The reader is referred to the 1963 U.S. Patent to Schwartz et al No. 3,079,479 for a more complete description of such adjustment means. The opposite end of said pin 68 has a friction spring 74 wound around it as best shown in FIGS. 2 and 4 so to retain whatever adjustment is preset by this pin 68.

To extinguish arcing caused by opening of the contacts 24 and 26, a stacked array of metal plates 66, 66 are supported within and by the two half cases 14 and 16 of the circuit breaker as best shown in FIGS. 1 and 3.

The collapsible link defined by members 34 and 36 have an internal spring to create a normal condition for said link members whereby they simply define a third bar for the three bar linkage described above. Thus, the collapsible link (34 and 36) together with the depending crank portion 40 of the handle 12, combine to provide a slight overcenter condition as viewed in FIGS. 1 and 2 (that is when the breaker is closed) and this spring 64 serves to hold the collapsible link (or third bar of the linkage defined by the links 34 and 36) in this same condition when the circuit breaker mechanism is moved to the "open" position depicted in FIGS. 3 and 4. The function of this collapsible link or toggle will be described in greater detail hereinbelow with reference to FIG. 5 wherein these link elements 34 and 36 are unlatched by suitable means to be described, including the pin 60 associated with latch means carried by the collapsible link itself.

As best shown in FIG. 5, the contact arm 28 is in the switch "open" condition but handle 12 is "on". The collapsible link has been unlatched however, and this condition would be caused by an overload condition even with the handle held or restrained in the "on" position. In this situation the toggle collapses independently of the handle position providing "trip free" breaker operation.

Still with reference to FIG. 5, the collapsible toggle formed by the interconnected links 34 and 36 shown in its collapsed condition, and by way of comparison to FIG. 1, the pivot pin 68 on contact arm 28 is shown in FIG. 1 as being generally in line with pin 82 provided between the toggle links 34 and 36 and with the pivot pin 37 on the crank arm 40. By way of contrast in FIG. 5 the toggle pivot 82 is displaced to the right with respect to this line between pivot pin 68 on contact arm 28 and pivot pin 37 on crank arm 40. The pin 60 for the latch means described above is ineffective in the "trip free" configuration illustrated in FIG. 5. However, as long as the armature remains in the position shown in FIG. 5 (that is energized) movement of the handle 12 from the "on" position shown to the "off" position (not shown) will result in return of the toggle to its latched position, but return movement of the handle 12 to the "on" position shown in FIG. 5 will recollapse the toggle to the position shown as a result of engagement between the pin 60 and a ramp surface 58*a* defined for this purpose on depending leg 58 of the armature 32. It should be recalled that pin 60 tends to move generally vertically between the position shown for it in FIGS. 1 and 3. The FIG. 5 position for this pin 60 corresponds quite closely to that illustrated in FIG. 3 (that is to the upper position for this pin).

Turning next to a detailed description of the unique common trip member for use with each of the circuit breaker mechanisms provided in a multi-pole assembly of the type disclosed herein, and referring particularly to the exploded view of FIG. 7, one such common trip member is there illustrated at 90 and can be seen to have a generally U-shape such that the legs of the U are adapted to be located adjacent the inside walls of each case. A cam follower roller 92 (FIG. 4) is provided on the pivotable contact arm 28 such that this roller is adapted engage a portion of one leg of the U-shaped common trip member 90, such portion being indicated generally at 94 in FIG. 7. This portion 94 would be on one leg of the U, as viewed in FIGS. 1 and 4, the other leg comprising a generally inverted V-shape best shown in FIG. 7 at 95 and 96. The portion 96 of said other leg is engageable with the pin 60 to cause the breaker to trip either as a result of normal opening movement as described above, or by trip free motion as a result of collapsing of the toggle as also described above. It is an important feature of the present invention that rotational movement of this U-shaped common trip member about its axis of rotation as defined by the aligned openings 94*a* and 96*a* in its respective leg portions will also cause the breaker to trip due to tripping of an adjacent breaker.

Each unit has its own U-shaped trip member 90 provided therein, and these U-shaped trip members are connected to one another by a common trip coupler 100 best shown in the exploded view of FIG. 7. This coupler has a disc portion 101 located in a generally circular recess or cavity defined by the abutting side walls of the adjacent breaker cases, and more particularly each such side wall has a circular opening 102 and 104 as indicated for the case halves 14 and 16 respectively.

The coupler 100 has oppositely arranged portions cooperating with portions of the U-shaped common trip member 90 inside each of these adjacent cases. For example, the coupler 100 has projections 100*a* and 100*b* which projections fit into openings 90*a* and 90*b* in that leg of the U-shaped trip member 90 located adjacent the inside wall of the breaker case 14. Oppositely projecting portions 100*c* and 100*d* fit into openings such as shown at 90*c* and 90*d* for the trip member 90. Obviously, the trip member would receive the corresponding projections on an adjacent coupler (not shown) and the coupler 100 would have its projections 100*c* and 100*d* received in such openings provided in the trip member of an adjacent case (not shown). This coupler 100 cooperates with the trip members in the adjacent breaker cases to cause pivotal movement of one of said members (as caused for the reasons mentioned in the preceeding paragraph) to move the coupler and in turn to effect pivotal movement of a trip member in an adjacent case.

The coupler 100 also has projections 100*e* and 100*f* located in the plane of the generally circular disc portion 101 of this coupler element, and these projections 100*e* and 100*f* fit into corresponding recesses, 104*e* and 104*f*, which recesses cooperate with similar recesses (not shown) provided on the outside of the adjacent case half 14 so that the coupler 100 is captured between the adjacent cases but is free to move arcuately and thereby follow the limited angular motion of the U-shaped trip members to which it is connected or coupled.

Still with reference to FIG. 7, an arcuate slot is provided in each of these case halves 14 and 16 each of which slots 14*a* and 16*a* are formed as a continuation of the opening 102 in breaker case 14 and of the opening 104 in breaker case 16. These slots are aligned with one another and serve to provide a path of movement for an elongated bar 120. The bar 120 extends through openings provided in the boss of each of the crank arms 40 for each of the adjacent switch case mechanisms or circuit breakers with the result that each of the three crank arms 40, 40 are required to move together, and in unison with one another as best shown in FIG. 6. It is an important feature of the present invention that only the central circuit breaker switch case defines a boss 10*a*, which boss has handle 12 movably mounted therein in order to provide control over the position of the internally linked or interconnected handle crank portions 40 in each of the three adjacent circuit breaker cases. Thus, the three circuit breaker mechanisms shown in FIG. 8 are adapted to be turned "on" or "off" in unison by means of the single projecting handle 12 and this mechanical switching action of the circuit breaker is provided in an assembly wherein electromagnetic tripping of any one of the three circuit breakers will necessarily trip the other two breakers through the common trip members 100, 100 and couplers 90, 90 described above.

As best shown in FIG. 8 the installation of a circuit breaker assembly such as described herein is greatly simplified by reason of the fact that there is no need to disassemble the handles, as required for example in prior U.S. Pat. No. 3,272,934. More particularly, the installer or user of the breaker shown in the subject disclosure permits the installer to simply provide the breaker behind a panel and to attach the breaker by means of two or more screws with only one hole for the handle boss 10*a* being required to be drilled in such a panel. Since there is no necessity for linking the handles of adjacent circuit breakers in a single multi-pole breaker assembly as required in prior art breakers, the installer does not have to first disassemble then install and then reassemble the various handles of a typical prior art multi-pole circuit breaker.

We claim:

1. The combination of a plurality of circuit breaker units, each unit having its own case containing; a pair of relatively movable contacts, an automatically resettable mechanism including a pivotable contact arm movable between open and closed positions, a tripping device including an armature pivotally movable toward and away from an electromagnetic coil or the like, said mechanism including a crank arm movable between "on" and "off" positions and a collapsible link with one end pivotally connected to said crank arm and its other end to said contact arm, latch means for preventing said link from collapsing, and means for disabling said latch means when said crank arm is moved "on" and said armature has been moved toward said coil, a common trip member of U-shape, with one leg of the "U" located adjacent one inside wall of the case and having a portion engageable with the associated resettable mechanism, the other leg of the U-shaped common trip member having a portion engageable with said means for disabling said latch means; at least two mating cases having abutting side walls assembled adjacent one another and having aligned openings defining a cavity, a common trip coupler located in said cavity and having opposing portions cooperating with portions of the U-shaped common trip members inside adjacent switch cases to cause pivotal movement of one of said members to move said coupler and in turn to effect pivotal movement of the trip member in the adjacent case.

2. The combination defined by claim 1 wherein said common trip member one leg portion is engageable with said movable contact arm during said contact opening movement, and said other leg portion of said U-shaped common trip member being engageable by a projection on said latch disabling means to cause the said trip member to move and the contacts to open.

3. The combination defined by claim 1 wherein each said tripping device includes an electromagnetic device including a fixed frame and said armature pivotally carried by the frame for initiating movement of said mechanism to the contact open position upon overload, said U-shaped common trip member also pivotally mounted to said frame.

4. The combination defined by claim 3 wherein said means for disabling said latch has one portion for engaging said armature to collapse said collapsible link upon overload, and said latch disabling means also having a portion engageable with said other U-shaped leg to cause collapse of said collapsible link regardless of its associated armature position and in response to pivotal movement of said common trip member only.

5. The combination defined by claim 1 wherein at least two breaker units are assembled adjacent one another, and wherein one of said crank arms for said two adjacent breaker units having a portion projecting outside the breaker case, and both crank arms having portions inside their respective breaker cases.

6. The combination defined by claim 5 further characterized by an elongated bar extending through openings provided in said crank arm portions inside the assembled switch cases, said abutting side walls having aligned slots to receive said bar and to allow pivotal motion of said crank arms in unison with one another, said combination providing a gang barred multi-pole breaker assembly having only one external handle and defining an overall housing no larger than that of the assembled individual breaker cases.

7. The combination defined in claim 1 wherein said trip members are fabricated from a plastic material and said common trip coupler is also of plastic material.

8. A multi-pole circuit breaker comprising in combination a plurality of similar units each of which units includes; a case, at least one movable contact, a fixed frame for supporting an electromagnetic coil, an armature pivotally supported in said frame for movement toward and away from said electromaganetic coil, resettable linkage mechanism including a pivotal contact arm movable between open and closed positions and a pivotable crank arm mounted in said frame for movement between "on" and "off" positions, said mechanism including a collapsible link with one end pivotally connected to said crank arm and the other end to said contact arm, latch means for preventing said link from collapsing, and means for disabling said latch means when said crank arm is moved "on" and said armature has moved toward said coil; an automatically resettable common trip member pivotally mounted inside each case for limited movement on the same axis as that provided for said armature, said common trip member having a U-shape with the legs defining said pivot and with one leg having a portion engageable with said means for disabling said latch means and the other leg having a portion engageable by said contact arm, and a common trip coupler between adjacent units with portions cooperating with said U-shaped common trip members inside the associated cases to cause pivotal movement of one such common trip member to move said coupler and in turn to effect movement of the trip member in another breaker unit, said cases being assembled in side-by-side relationship such that their side walls abut one another and so that crank arm pivot axes are defined by said frames in aligned relationship to support said crank arms, one only of said crank arms having a handle portion projecting outwardly through an opening in its associated switch case, all of said crank arms having inner portions located inside their associated cases, all said inner crank arm portions defining openings equally spaced from their associated crank arm pivot axes, and an elongated bar extending through said crank arm openings and through arcuate slots defined in the abutting case side walls.

9. The combination defined in claim 8 wherein said crank arms are fabricated from a plastic material and said bar is of metal with at least one splined portion to fit securely in at least one crank arm opening for securing that crank arm to said bar.

10. In a multipole circuit breaker of the type having single pole units stacked side-by-side, each unit having its own case with a pair of cooperating contacts one of which is movable relative to the other by a resettable mechanism, a tripping device responsive to fault current conditions to trip the resettable mechanism, and means for preventing said resettable mechanism from functioning; the improvement comprising a common trip member of U-shape with one leg of the "U" located adjacent one inside wall of the case and with a portion of said one leg engageable with the resettable mechanism and with the other leg having a portion engageable with said preventing means, at least two mating cases having abutting side walls assembled adjacent one another and having aligned openings defining a cavity, a common trip coupler located in said cavity and having opposing portions cooperating with portions of the U-shaped common trip members inside adjacent switch cases to cause pivotal movement of one of said members to move said coupler and in turn to effect pivotal movement of the trip member in the adjacent case.

11. The combination defined by claim 10 further characterized by one only of said crank arms having a multi-pole circuit breaker comprising in combination a plurality of similar units each of which units includes; a case, at least one movable contact, a fixed frame for supporting an electromagnetic coil, an armature pivotally supported in said frame for movement toward and away from said electromagnetic coil, resettable linkage mechanism including a pivotal contact arm movable between open and closed positions and a pivotable crank arm mounted in said frame for movement between "on" and "off" positions, said mechanism including a collapsible link with one end pivotally connected to said crank arm and the other end to said contact arm, latch means for preventing said link from collapsing, and means for disabling said latch means when said crank arm is moved "on" and said armature has moved toward said coil; said cases being assembled in side-by-side relationship such that their side walls abut one another and so that crank arm pivot axes are defined by said frames in aligned relationship to support said crank arms, one only of said crank arms having a handle portion projecting outwardly through an opening in its associated switch case, all of said crank arms having inner portions located inside their associated cases, all said inner crank arm portions defining openings equally spaced from their associated crank arm pivot axes, and an elongated bar extending through said crank arm openings and through arcuate slots defined in the abutting case side walls.

* * * * *